US006747625B1

(12) United States Patent
Han et al.

(10) Patent No.: US 6,747,625 B1
(45) Date of Patent: Jun. 8, 2004

(54) DIGITAL DRIVING CIRCUIT FOR LIQUID CRYSTAL DISPLAY

(75) Inventors: Chul-Hi Han, Taejon (KR); Hoon-Ju Chung, Taejon (KR); Seung-Woo Lee, Seoul (KR)

(73) Assignee: Korea Advanced Institute of Science and Technology, Taejon-si (KR)

( * ) Notice: Subject to any disclaimer, the term of this patent is extended or adjusted under 35 U.S.C. 154(b) by 128 days.

(21) Appl. No.: 09/628,040

(22) Filed: Jul. 27, 2000

(30) Foreign Application Priority Data

Aug. 7, 1999 (KR) ..... 99-32464

(51) Int. Cl.[7] ..... G09G 3/36

(52) U.S. Cl. ..... 345/98; 345/87; 345/90; 345/92; 345/94; 345/95; 345/98; 345/99; 345/100; 345/204; 345/213

(58) Field of Search ..... 345/87, 90, 94, 345/92, 95, 98, 99, 100, 213, 204

(56) References Cited

U.S. PATENT DOCUMENTS 5,576,737 A 11/1996 Isozaki
5,856,816 A * 1/1999 Youn ..... 345/98
5,956,010 A 9/1999 Asao et al.
6,008,801 A * 12/1999 Jeong ..... 345/204
6,014,122 A 1/2000 Hashimoto
6,069,605 A 5/2000 Ozawa
6,097,362 A * 8/2000 Kim ..... 345/87
6,157,358 A * 12/2000 Nakajima et al. ..... 345/96
6,219,020 B1 * 4/2001 Furuhashi et al. ..... 345/100
6,256,005 B1 * 7/2001 Kim ..... 345/88
6,333,730 B1 * 12/2001 Lee ..... 345/100
6,380,917 B2 * 4/2002 Matsueda et al. ..... 345/89
6,384,806 B1 * 5/2002 Matsueda et al. ..... 345/89

* cited by examiner

*Primary Examiner*—Regina Liang
*Assistant Examiner*—Jennifer T. Nguyen
(74) *Attorney, Agent, or Firm*—Bachman & LaPointe, P.C.

(57) ABSTRACT

A digital driving circuit for a liquid crystal display which sequentially receives and displays n-bit digital video information from a data bus on a bit basis. The digital driving circuit comprises a first data latch for sequentially storing the digital video information from the data bus on a bit basis, a shift register for synchronizing a latching operation of the first data latch with bit positions of the digital video information from the data bus, a second data latch for storing the digital video information stored in the first data latch temporarily before digital/analog conversion, and a digital/analog converter for sequentially converting the digital video information stored in the second data latch into analog signals on a bit basis. The digital driving circuit is able to sequentially process bit information of digital video information to reduce the number of data bus lines for loading the bit information thereon and the number of data catches arranged vertically to a column direction. Therefore, the driving circuit can be significantly reduced in its occupying width, thereby making it possible to make the display higher in density.

4 Claims, 4 Drawing Sheets

DIGITAL DRIVING CIRCUIT FOR LIQUID CRYSTAL DISPLAY

BACKGROUND OF THE INVENTION

1. Field of the Invention

The present invention relates in general to a digital driving circuit for a liquid crystal display (LCD), and more particularly to a digital driving circuit having an improved construction with such a reduced width as to be applicable to a high-density LCD.

2. Description of the Prior Art

With the development of multimedia systems, the amount of information being used therein has recently increased at the ratio of a geometric progression and it has also been accelerated to make the resolution and density of a display higher to display the increased amount of information. In particular, in order to act up to a high densification of an LCD that is a representative runner in a flat display field, making the density of a panel of the LCD higher is in progress.

In an LCD using polysilicon thin-film transistors, a peripheral driving circuit must occupy a smaller area on a panel to increase the size of a screen. To this end, researches have been conducted in reducing a width or the LCD panel occupied by the driving circuit. One approach is to reduce a line width of the driving circuit.

However, a fabrication process for reducing the line width of the driving circuit is so complicated as to cause various problems such as an increase in inferiority rate, a degradation in productivity, etc. Further, it is inevitable to make a large-scale facility investment to perform the complicated fabrication process.

As a result, there has been required a method for structurally reducing the width of the driving circuit by modifying a method of driving the polysilicon thin-film transistors contained in the LCD.

FIG. 1 is a circuit diagram showing a part of a conventional digital driving circuit which receives all bits of digital video information at a time and drives an LCD, wherein the digital video information is of eight bits.

In FIG. 1, the reference numeral 10 denotes first transfer switches for transferring external input digital video information to a (j−1)th column, 11 denotes second transfer switches for transferring the external input digital video information to a jth column, and 12 denotes third transfer switches for transferring the external input digital video information to a (j+1)th column.

Also, the reference numeral 13 denotes a data bus for loading the external input digital video information thereon, 14 denotes a line of the data bus 13 corresponding to an eighth bit or most significant bit (MSB) of the 8-bit digital video information, and 15 denotes a line of the data bus 13 corresponding to a first bit or least significant bit (LSB) of the 8-bit digital video information.

Also, the reference numeral 16 denotes digital latches for temporarily storing the digital video information transferred by the first to third transfer switches 10–12, 17 denotes a first digital bus for transferring the digital video information stored in the digital latches 16 to the (j−1)th column, 18 denotes a second digital bus for transferring the digital video information stored in the digital latches 16 to the jth column, and 19 denotes a third digital bus for transferring the digital video information stored in the digital latches 16 to the (j+1)th column.

The data bus 13 is composed of eight lines from the LSB data bus line 15 up to the MSB data bus line 14, which extend in a row direction (i.e., a vertical direction to the column direction).

The operation of the conventional digital driving circuit with the above-mentioned construction will hereinafter be described.

First, when jth digital video information is loaded on the data bus 13, the second transfer switches 11 are turned on to transfer it to the jth column. At this time, the digital video information is stored in the data latches 16 through the turned-on second transfer switches 11. Then, the digital video information stored in the data latches 16 is transferred to a digital/analog converter (not shown) through the second digital bus 18 of the jth column so that it can be converted into an analog signal.

However, the conventional digital driving circuit for the LCD requires eight data bus lines and a large number of data latches arranged in the row direction as shown in FIG. 1 to drive one column for the process of 8-bit digital video information. As a result, the data bus and inverters used as the data latches occupy a large area on a panel of the LCD.

In other words, because of the simultaneous process of all bit information, the conventional digital driving circuit for the LCD requires the same number of data bus lines as that of bits to be processed and the associated number of data latches for data storage arranged vertically to the column direction to drive one column, resulting in an increase in the area on the LCD panel occupied by inverters used as the data latches. This makes it difficult to integrate the digital driving circuit on the LCD panel with a narrow width and thus to make the LCD higher in density.

SUMMARY OF THE INVENTION

Therefore, the present invention has been made in view of the above problems, and it is an object of the present invention to provide a digital driving circuit for a liquid crystal display which is capable of sequentially processing bit information of digital video information to reduce the number of data bus lines and data latches used therein.

In accordance with the present invention, the above and other objects can be accomplished by a provision of a digital driving circuit for a liquid crystal display which sequentially receives and displays n-bit digital video information from a data bus on a bit basis, comprising a first data latch for sequentially storing the digital video information from the data bus on a bit basis; a shift register for synchronizing a latching operation of the first data latch with bit positions of the digital video information from the data bus; a second data latch for storing the digital video information stored in the first data latch temporarily before digital/analog conversion; and a digital/analog converter for sequentially converting the digital video information stored in the second data latch into analog signals on a bit basis.

Preferably, the digital driving circuit further comprises an analog buffer connected between the digital/analog converter and a data line, the analog buffer being enabled when the data line has a large parasitic capacity.

Further, preferably, the data bus is composed of a single line and the first data latch receives and stores digital video information of one column from the data bus line. Alternatively, the data bus may be composed of first and second lines and the first data latch may receive and store digital video information of one column from the first data bus line and an inverted version of the digital video signal of the column from the second data bus line.

Further, preferably, the digital/analog converter includes first and second electrostatic capacitors connected in parallel to each other and having the same electrostatic capacity, the first and second electrostatic capacitors cooperating to output a charged voltage value as an analog signal; a charging switch connected to a first reference voltage source for charging the first and second electrostatic capacitors when bit information of the digital video information from the second data latch is 1 in logic; a discharging switch connected to a second reference voltage source for discharging the first and second electrostatic capacitors when the bit information of the digital video information from the second data latch is 0 in logic; a redistribution switch connected between the first and second electrostatic capacitors for redistributing charges stored thereon; and an initialization switch for initializing voltages across the first and second electrostatic capacitors.

BRIEF DESCRIPTION OF THE DRAWINGS

The above and other objects, features and advantages of the present invention will be more clearly understood from the following detailed description taken in conjunction with the accompanying drawings, in which.

DETAILED DESCRIPTION OF THE PREFERRED EMBODIMENTS

Figure 1:
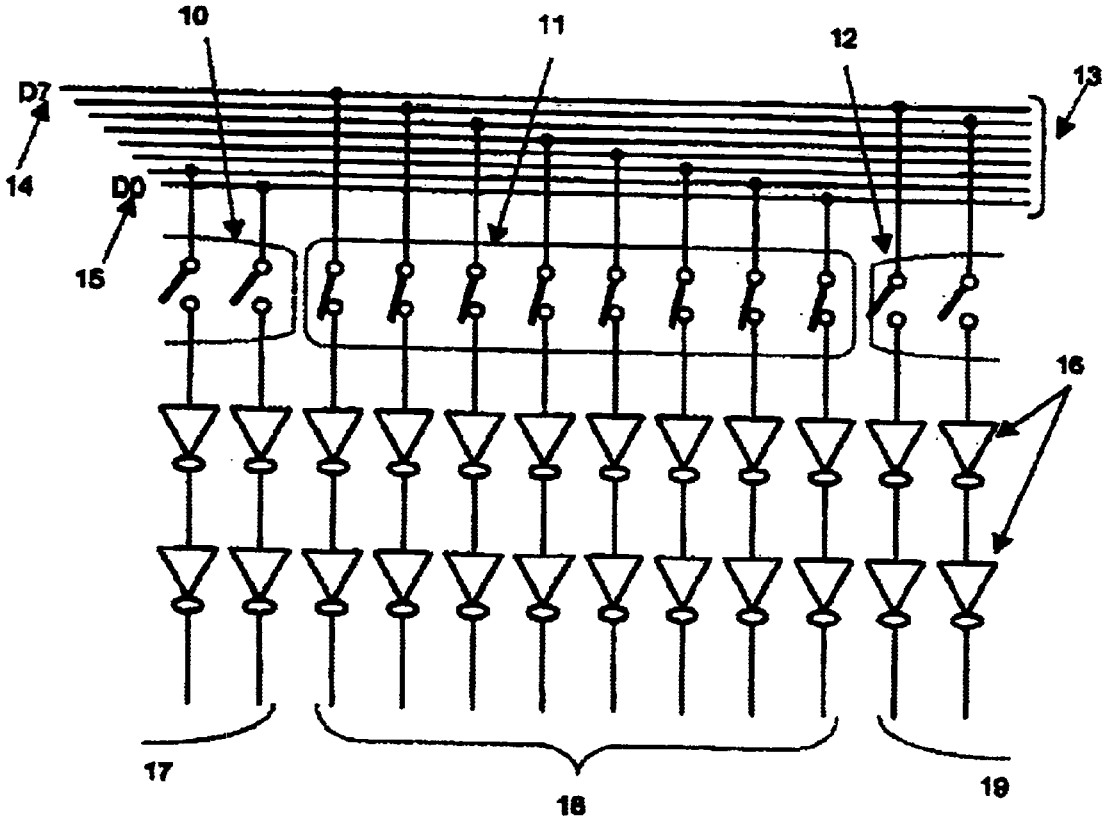
Prior Art Fig. 1
FIG. 1 is a circuit diagram showing a part of a conventional digital driving circuit for simultaneously processing digital bit information.
Figure 2:
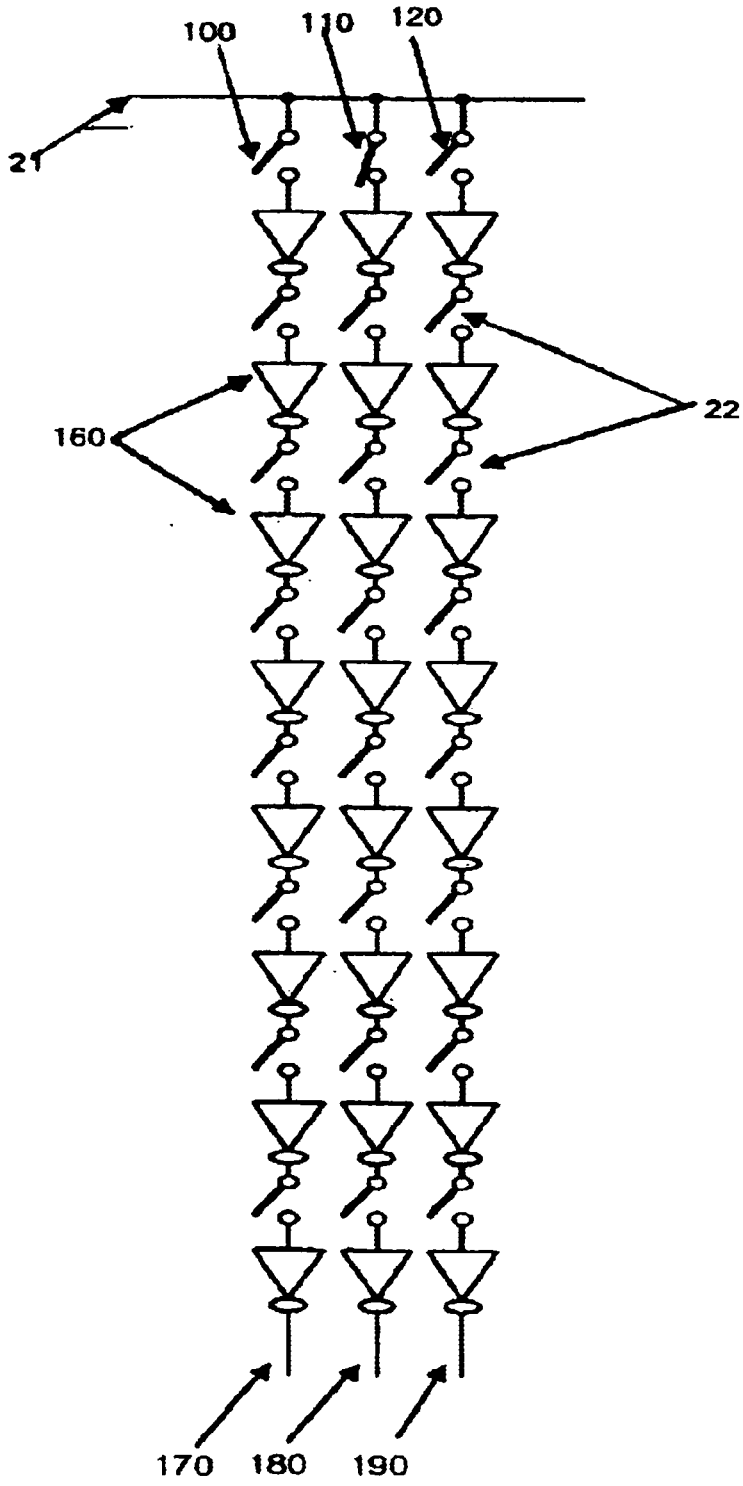
FIG. 2 is a circuit diagram showing a part of a digital driving circuit for sequentially processing digital but information in accordance with the present invention.

FIG. 2 is a circuit diagram showing a part of a digital driving circuit for sequentially processing digital bit information in accordance with the present invention.

In FIG. 2, the reference numeral 100 denotes a first transfer switch for transferring 8-bit digital video information to a (j−1)th column, 110 denotes a second transfer switch for transferring the digital video information to a jth column, and 120 denotes a third transfer switch for transferring the digital video information to a (j+1)th column.

Also, the reference numeral 160 denotes a plurality of digital latches connected in series of eight in every column for temporarily and sequentially storing the 8-bit digital video information transferred by corresponding ones of the first to third transfer switches 100–120, 170 denotes a first digital bus for transferring the digital video information stored in the digital latches 160 to the (j−1)th column, 180 denotes a second digital bus for transferring the digital video information stored in the digital latches 160 to the jth column, and 190 denotes a third digital bus for transferring the digital video information stored in the digital latches 160 to the (j+1)th column.

Also, the reference numeral 21 denotes a data bus for sequentially loading the digital video information thereon, and 22 denotes a plurality of transfer control switches, each being provided between adjacent ones of the digital latches 160 in every column for controlling a sequential bit-unit transfer of the digital video information therebetween.

When the digital driving circuit is constructed in the above manner according to the present invention, it can be reduced in width because the digital latches 160 are connected in series in a column direction.

Figure 3:
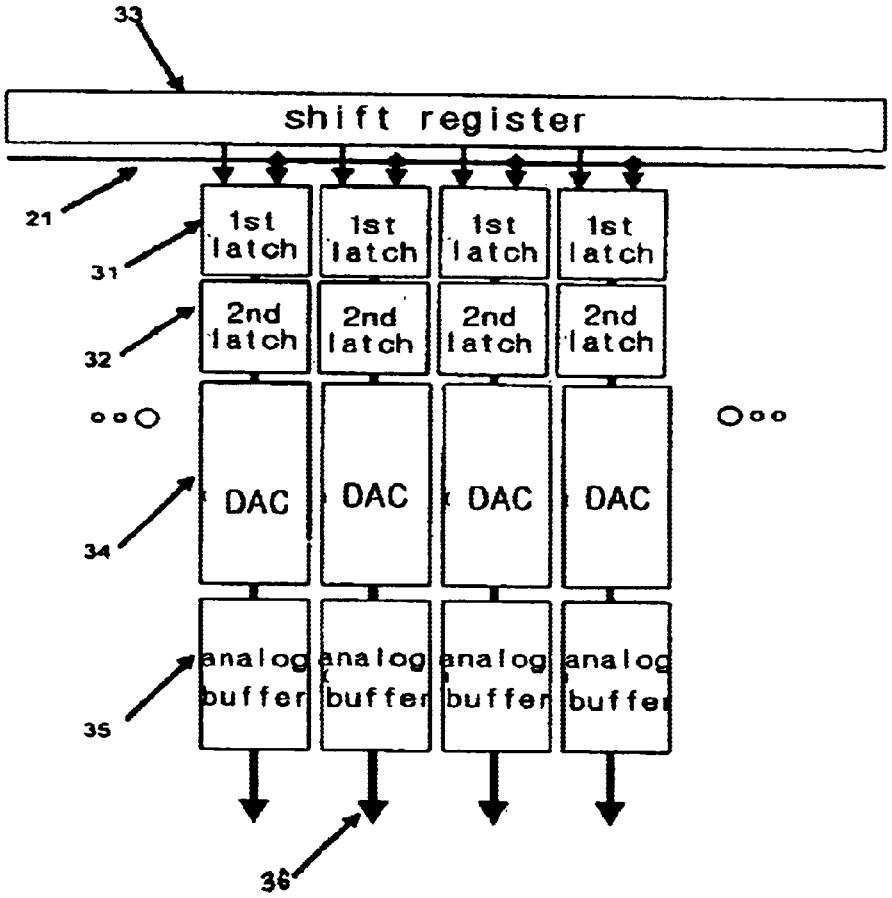
FIG. 3 is a block diagram illustrating the concept of the digital driving circuit in accordance with the present invention.

FIG. 3 is a block diagram illustrating the concept of the entire digital driving circuit including the construction of FIG. 2.

In FIG. 3, the reference numeral 21 denotes a data bus for sequentially loading digital video information thereon, 31 denotes a plurality of first data latches, each sequentially storing digital video information of a corresponding column from the data bus 21, 32 denotes a plurality of second data latches, each being connected to a corresponding one of the first data latches 31 for storing the digital video information stored, in the corresponding first data latch temporarily before digital/analog conversion, and 33 denotes a shift register for synchronizing latching operations of the first data latches 31 with bit positions of the digital video information from the data bus 21.

Also, the reference numeral 34 denotes a plurality of digital/analog converters (DACs), each being connected to a corresponding one of the second data latches 32 for sequentially converting the digital video information stored in the corresponding second data latch into analog signals on a bit basis, and 35 denotes a plurality of analog buffers, each being enabled when a corresponding one of data lines 36 has a large parasitic capacity.

Now, a detailed description will be given of a digital video information processing operation of the digital driving circuit with the above-mentioned construction in accordance with the present invention.

First, digital video information of every column is loaded on the data bus 21, which is composed of a single line. The first data latches 31 sequentially store the digital video information of the associated columns from the data bus 21 according to bit positions thereof in response to output signals from the shift register 33, respectively. If the digital video information of all the columns are stored in the first data latches 31, then they are transferred to the second data latches 32. Thereafter, the first data latches 31 sequentially store new digital video information.

On the other hand, the digital video information transferred to the second data latches 32 are stored therein and then converted by the DACs 34 into analog signals, which are subsequently outputted through the analog buffers 35 and data lines 36. At this time, the analog buffers 35 are enabled according to parasitic capacities of the associated data lines 36.

Figure 4:
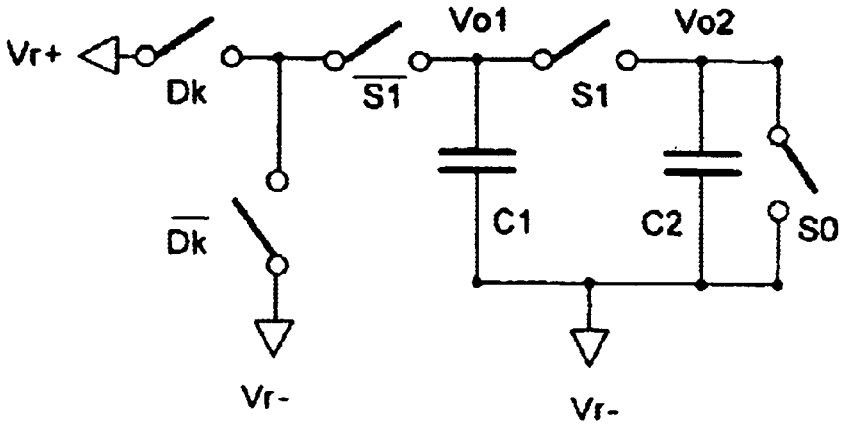
FIG. 4 is a circuit diagram showing the construction of a serial digital/analog converter for sequentially converting digital bit information into analog signals in accordance with the present invention.

FIG. 4 is a circuit diagram showing the construction of each of the serial DACs 34 for sequentially converting digital bit information from the associated second data latches 32 into analog signals in accordance with the present invention.

In FIG. 4, the reference character Vr+ denotes one of two reference voltages necessary to the digital/analog conversion, Vr− denotes the other reference voltage, Dk denotes a charging switch turned on when bit information of digital video information from the associated second data latch 32 is 1 in logic, and /Dk denotes a discharging switch turned on when the bit information is 0 in logic. Also, the reference numeral C1 denotes a first electrostatic capacitor, C2 denotes a second electrostatic capacitor, S1 denotes a redistribution switch for redistributing charges stored on the first and second electrostatic capacitors C1 and C2, /S1 denotes an isolation switch turned off when the charges stored on the first and second electrostatic capacitors C1 and C2 are redistributed by the redistribution switch S1, to isolate them from the first and second reference voltages Vr+ and Vr−, and S0 denotes an initialization switch for initializing a voltage across the second electrostatic capacitor C2.

Also, the reference numeral Vo1 denotes a voltage across the first electrostatic capacitor C1, and Vo2 denotes the voltage across the second electrostatic capacitor C2.

Figure 5:
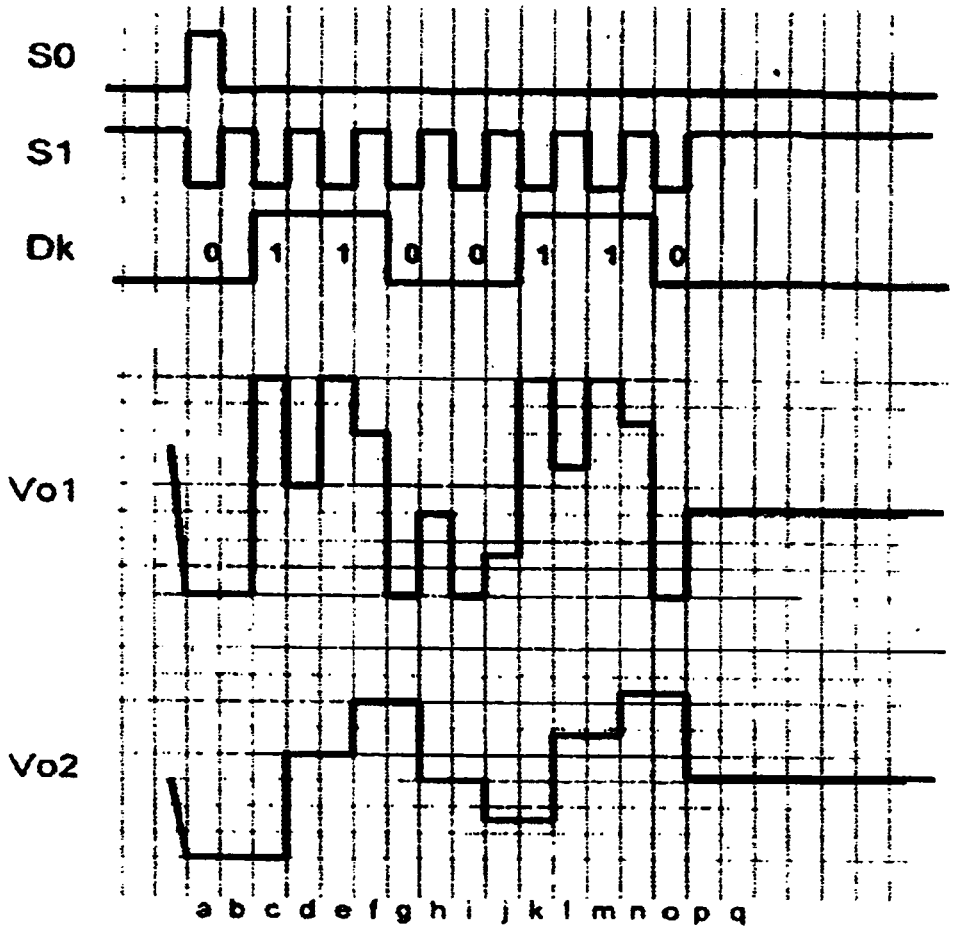
FIG. 5 is a timing diagram illustrating the operation of the serial digital/analog converter of FIG. 4.

Next, a detailed description will be given of the operation of the serial DAC 34 with the above-mentioned construction in accordance with the present invention with reference to a timing diagram of FIG. 5.

Initially, the initialization switch S0 is turned on to discharge the second electrostatic capacitor C2, which has the same electrostatic capacity as that of the first electrostatic capacitor C1. Thereafter, the charging switch Dk is turned on if bit information of digital video information from the associated second data latch 32 is 1 in logic and the discharging switch /Dk is turned on if the bit information is 0 in logic, thereby causing the first electrostatic capacitor C1 to be charged or discharged.

Thereafter, if the charging or discharging operation is completed with respect to one bit information of the digital video information, then the redistribution switch S1 is turned on to redistribute charges stored on the first and second electrostatic capacitors C1 and C2. At this time, the isolation switch /S1 is turned off to isolate the charges stored on the first and second electrostatic capacitors C1 and C2 from the first and second reference voltages Vr+ and Vr−.

When the charging or discharging operation is performed with respect to MSB information of the digital video information and the final redistribution of charges is then completed in the above manner, any one of the respective voltages Vo1 and Vo2 across the first and second electrostatic capacitors C1 and C2 becomes a desired final analog value.

Assume that the digital video information from the associated second data latch 32 is 8-bit data of 01100110. In this case, as shown in FIG. 5, the voltage Vo2 across the second electrostatic capacitor C2 becomes the second reference voltage Vr− in an initial time interval a because the second electrostatic capacitor C2 is initialized. At this time, the voltage Vo1 across the first electrostatic capacitor C1 becomes the second reference voltage Vr−, too, because LSB information of the digital video information is 0 in logic. Thereafter, the redistribution of charges is performed in a time interval b. In this case, there is no variation in the voltages Vo1 and Vo2 across the first and second electrostatic capacitors C1 and C2 because they have the same level.

Thereafter, the voltage Vo1 across the first electrostatic capacitor C1 becomes the first reference voltage Vr+ in a time interval c because the subsequent bit information of the digital video information is 1 in logic. Subsequently, the redistribution, of charges is performed, thereby causing the voltages Vo1 and Vo2 across the first and second electrostatic capacitors C1 and C2 to have middle levels of the first and second reference voltages Vr+ and Vr−, respectively. Then, since the next bit information of the digital video information is 1 in logic, the voltage Vo1 across the first electrostatic capacitor C1 has a level of $(Vr+-Vr-)\times(3/4)+Vr-$ after the redistribution of charges is performed.

If the above digital/analog conversion operation is performed up to MSB information of the digital video information, the voltage Vo1 across the first electrostatic capacitor C1 has the final level of $(Vr+-Vr-)\times(102/256)+Vr-$, resulting in the conversion operation being completed.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

Further, this applicant could recognize from a number of experiments that the technical concept of the present invention is most favorable to LCDs employing polysilicon thin-film transistors. The reason is that a conventional driving circuit for one column cannot be contained within a given width of such an LCD employing the polysilicon thin-film transistors because a minimum line width necessary to a fabrication process of that LCD is on the order of several m. However, the technical concept of the present invention is applicable to LCDs employing thin-film transistors made of monosilicon or amorphous silicon as well as polysilicon.

As apparent from the above description, the present invention provides a digital driving circuit for an LCD which is capable of sequentially processing bit information of digital video information to reduce the number of data bus lines or loading the bit information thereon and the number of data latches arranged vertically to a column direction, respectively, to even one. Therefore, the driving circuit can be significantly reduced in its occupying width, thereby making it possible to make the LCD higher in density.

What s claimed is:

1. A digital driving circuit for a liquid crystal display which receives n-bit digital video information sequentially on a bit basis from a data bus and displays said digital video information, comprising:

a data bus composed of a single line per column for sending the n-bit digital video information sequentially on a bit basis to the display;

a first data latch for sequentially storing said digital video information from said data bus on a bit basis;

a shift register for synchronizing a latching operation of said first data latch with bit positions of said digital video information from said data bus;

a second data latch for storing said digital video information stored in said first data latch temporarily before digital/analog conversion; and a digital/analog converter for sequentially converting said digital video information stored in said second data latch into analog signals on a bit basis.

2. The digital driving circuit as set forth in claim 1, further comprising an analog buffer connected between said digital/analog converter and a data line, said analog buffer being enabled when said data line has a large parasitic capacity.

3. The digital driving circuit as set forth in claim 1, wherein said data bus is composed of first and second lines, said first data latch receiving and storing digital video information of one column from said first data bus line and an inverted version of said digital video signal of said column from said second data bus line.

4. The digital driving circuit as set forth in claim 1, wherein said digital/analog converter includes:

first and second electrostatic capacitors connected in parallel to each other and having the same electrostatic capacity, said first and second electrostatic capacitors cooperating to output a charged voltage value as an analog signal;

a charging switch connected to a first reference voltage source for charging said first and second electrostatic capacitors when bit information of said digital video information from said second data latch is 1 in logic;

a discharging switch connected to a second reference voltage source for discharging said first and second electrostatic capacitors when said bit information of said digital video information from said second data latch is 0 in logic;

a redistribution switch connected between said first and second electrostatic capacitors for redistributing charges stored thereon; and an initialization switch for initializing voltages across said first and second electrostatic capacitors.

* * * * *